US008630430B2

(12) United States Patent
Akino

(10) Patent No.: US 8,630,430 B2
(45) Date of Patent: Jan. 14, 2014

(54) CONDENSER MICROPHONE

(75) Inventor: Hiroshi Akino, Tokyo (JP)

(73) Assignee: Kabushiki Kaisha Audio-Technica, Tokyo (JP)

( * ) Notice: Subject to any disclaimer, the term of this patent is extended or adjusted under 35 U.S.C. 154(b) by 379 days.

(21) Appl. No.: 13/034,731

(22) Filed: Feb. 25, 2011

(65) Prior Publication Data

US 2011/0222713 A1 Sep. 15, 2011

(30) Foreign Application Priority Data

Mar. 11, 2010 (JP) ..... 2010-054260

(51) Int. Cl.
*H04R 25/00* (2006.01)

(52) U.S. Cl.
USPC ..... 381/174; 381/191

(58) Field of Classification Search
USPC ..... 381/111, 113, 121, 122, 173, 174, 191, 381/361; 379/384, 395, 395.01, 400; 330/145, 284
See application file for complete search history.

(56) References Cited

U.S. PATENT DOCUMENTS 6,160,450 A * 12/2000 Eschauzier et al. ..... 381/121

FOREIGN PATENT DOCUMENTS

JP 2006-352622 12/2006

* cited by examiner

*Primary Examiner* — Brian Ensey
(74) *Attorney, Agent, or Firm* — Whitham Curtis Christofferson & Cook, PC

(57) ABSTRACT

A condenser microphone has an output circuit comprising an emitter-follower circuit; an impedance converter comprising an FET and at least one transistor of the emitter-follower circuit provided next to the FET; and the transistor having an emitter terminal provided with a constant-voltage circuit. The FET included in the impedance converter is operated by a voltage supplied from the constant-voltage circuit.

4 Claims, 5 Drawing Sheets

CONDENSER MICROPHONE

BACKGROUND OF THE INVENTION

1. Field of the Invention

The present invention relates to a condenser microphone having an emitter-follower output circuit that can increase the maximum output level without a transformer.

2. Related Background Art

Power supply systems for condenser microphones and other microphones are set forth in the EIAJ standard (RC-8162A). The EIAJ standard relates to a phantom power source and defines three types of supply voltages (12 V, 24 V, and 48 V). In the case where a phantom power source is used for a condenser microphone, the maximum amplitude of the output from the condenser microphone is thus 48 $V_{P-P}$).

In order to increase the output from the condenser microphone, a transformer may be provided in an output circuit thereof. If it is not suitable to include a transformer in the output circuit, a transformer-free output circuit is employed. An emitter-follower circuit is generally used in such a transformer-free output circuit in view of reduced output impedance.

A conventional condenser microphone including such a transformer-free output circuit is explained with reference to FIG. 4. In FIG. 4, a condenser microphone unit 1 has one output terminal connected to an impedance converter 2 and the other terminal connected to a negative terminal of a phantom power source 3.

The output circuit includes emitter-follower connected transistors Tr1 and Tr2. The base terminals of the transistors Tr1 and Tr2 are connected to the respective output terminals of the condenser microphone unit 1 through respective capacitors. The positive terminal of the phantom power source 3 that supplies power to the condenser microphone unit 1 is connected to the respective emitters of the transistors Tr1 and Tr2 through supply resistors R1 and R2. Thus, the supply resistors R1 and R2 also serve as load resistors for the emitter-follower connected transistors Tr1 and Tr2, respectively.

The respective emitters of the transistors Tr1 and Tr2 are connected to output terminals (not shown in the drawing). Audio signals converted by the microphone unit1 are balance-output from the output terminals. For a voltage of the phantom power source 3 of 48 V, the resistance value of the supply resistors R1 and R2 is defined as 6.8 kΩ and the deviation as within 0.4%.

For balanced output from the condenser microphone unit 1, the collectors of the emitter-follower circuits on a hot side (Tr1) and a cold side (Tr2) are coupled. The collectors of the transistors Tr1 and Tr2, which must be AC-grounded, are connected to the negative terminal of the phantom power source 3 through a capacitor (capacitor C3) having a relatively high voltage resistance and a large electrostatic capacitance.

As described above, the condenser microphone including the transformer-free conventional output circuit is provided with the two emitter-follower connected transistors Tr1 and Tr2. The voltage generated between the two ends of the large capacitor C3 serves as a power source to operate the impedance converter 2, the capacitor C3 connecting the coupled collectors of the transistors Tr1 and Tr2 to the negative terminal of the phantom power source 3.

The impedance converter 2 shown in FIG. 4 has a bias built-in FET including a biasing resistor and a diode.

The voltage supplied from the phantom power source 3 is divided into a voltage required to operate the emitter-follower circuits, which are included in the output circuit composed of the transistors Tr1 and Tr2, and a voltage required to operate the impedance converter 2 connected to the condenser microphone unit.

The maximum input sound pressure level of the condenser microphone is restricted mainly by the signal amplitude in the output circuit. Thus, it is desirable that the voltage to operate the emitter-follower circuits and the voltage to operate the impedance converter 2 connected to the condenser microphone unit be both high. Such a condenser microphone having a transformer-free output circuit is designed so as to set the two voltages to appropriate values.

A challenge of the conventional transformer-free output circuit is explained below in the case where the phantom power source 3 supplies 48 V power. The voltage between the two ends of each of the supply resistors R1 and R2 (each have a resistance value of 6.8 kΩ) of the phantom power source 3 and the voltage between the emitter terminal and the collector terminal of each of the emitter-follower connected transistors Tr1 and Tr2 functioning as the output circuit are substantially the same as the voltage between the terminals of the capacitor C3 (operating voltage for the impedance converter 3) connected to the collectors of the transistors Tr1 and Tr2. Thus, in the case where the voltage of the phantom power source 3 is 48 V, these voltages described above are each substantially 24 V. In the conventional output circuit shown in FIG. 4, the maximum output level is then 24 $V_{P-P}$, and the maximum input sound pressure level is 18.7 dBV.

If an emitter-follower output circuit shown in FIG. 5 were to be used, the output level could be maximized. FIG. 5 is a diagram of a transformer-free output circuit of a condenser microphone, excluding an input side (a condenser microphone unit, for example). An emitter-follower circuit in FIG. 5 has a configuration similar to the emitter-follower circuit portion in FIG. 4. In the output circuit shown in FIG. 5, the voltage (48 V) supplied from the phantom power source 3 is divided into a voltage between two ends of each of supply resistors R1 and R2 and a voltage between an emitter terminal and a collector terminal of each of transistors Tr1 and Tr2.

Accordingly, the maximum output amplitude is substantially 24 V at each of output points C and D to which output terminals (not shown in the drawing) are connected in FIG. 5. In the output circuit in FIG. 5, the maximum output level is thus substantially 48 $V_{P-P}$, and the maximum input sound pressure level is approximately 24.76 dBV.

Unlike the output circuit shown in FIG. 4, however, the power cannot be supplied to operate the impedance converter 2 (refer to FIG. 1), which is connected to the subsequent stage of the microphone unit 1, in the output circuit shown in FIG. 5. In other words, the impedance converter cannot be used in the output circuit of FIG. 5.

No prior art was found that has an object to solve the technical challenge described above, specifically to increase the maximum output level while maintaining the operating voltage for the impedance converter in the condenser microphone. Japanese Unexamined Patent Application Publication No. 2006-352622 relates to a condenser microphone having an emitter-follower connected transistor, for amplifying current, connected between an impedance converter included in a condenser microphone unit and an output transformer.

SUMMARY OF THE INVENTION

In view of the circumstances above, an object of the present invention is to provide a condenser microphone having a transformer-free output circuit capable of increasing the maximum output level by securing a voltage to operate an impedance converter without a large capacitor.

The present invention relates to a condenser microphone having an output circuit comprising an emitter-follower circuit; and an impedance converter comprising an FET and at least one transistor of the emitter-follower circuit provided next to the FET; the transistor having an emitter terminal provided with a constant-voltage circuit. The FET included in the impedance converter is operated by a voltage supplied from the constant-voltage circuit.

In the condenser microphone, the output circuit comprises an emitter-follower circuit connected to one output terminal of the microphone unit and another emitter-follower circuit connected to the other output terminal of the microphone unit. An output signal from the microphone is balance-output from the emitters of the transistors of the two emitter-follower circuits.

Furthermore, the constant-voltage circuit in the condenser microphone comprises a diode; the diode having a cathode connected to the emitter terminal of the transistor and an anode connected to a supply resistor of a phantom power source.

In the condenser microphone having the transformer-free output circuit according to the present invention, the constant-voltage circuit is connected in series to the emitter terminal of the emitter-follower output circuit, and the operating voltage for the impedance converter is supplied from the constant-voltage circuit. The output level can thus be increased with a small output circuit without a large capacitor. In addition, the present invention provides a condenser microphone resistant to circuit noise and highly responsive to a low frequency.

DESCRIPTION OF THE PREFERRED EMBODIMENTS

Figure 1:
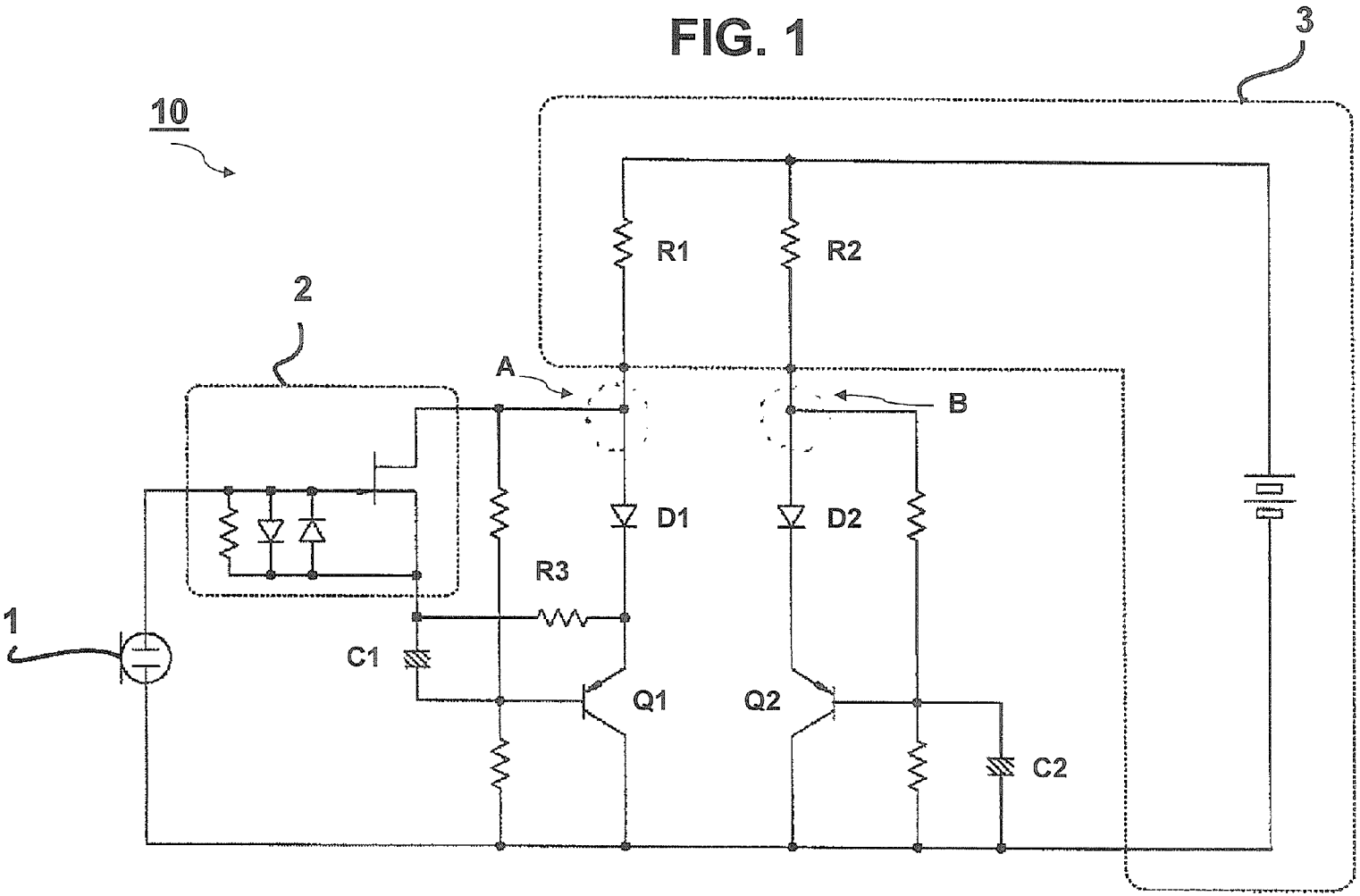
FIG. 1 is a circuit diagram illustrating an embodiment of a condenser microphone according to the present invention.

An embodiment of a condenser microphone according to the present invention is explained with reference to FIG. 1. In the drawing, an electret condenser microphone unit 1 has one end connected to an impedance converter 2 and the other end connected to a negative terminal of a phantom power source 3.

The positive terminal of the phantom power source 3 is connected to an emitter of a transistor Q1 through a supply resistor R1 and a diode D1, and to an emitter of a transistor Q2 through a supply resistor R2 and a diode D2. Thus, the supply resistors R1 and R2 also serve as load resistors for the emitter-follower connected transistors Q1 and Q2, respectively. The respective emitters of the transistors Q1 and Q2 are connected to output terminals (not shown in the drawing) in portions indicated by dotted line circles A and B, respectively. Audio signals converted by the microphone unit 1 are balance-output from the output terminals. For a voltage of the phantom power source 3 of 48 V, the resistance value of the supply resistors R1 and R2 is defined as 6.8 kΩ and the deviation as within 0.4%.

The diode D1, which is connected between the emitter of the transistor Q1 and the supply resistor R1, serves as a constant-voltage circuit. The resistance value of the diode D1 is approximately 1 kΩ, and thus the voltage drop between two ends thereof is approximately 0.7 V. The voltage applied between an anode and a cathode of an FET included in the impedance converter 3 through a resistor R3 operates the impedance converter 3.

The impedance converter 2 shown in FIG. 1 has a bias built-in FET including a biasing resistor and a diode.

As described above, the diode D1 is connected in series between the emitter terminal of the emitter-follower output circuit and the supply resistor R1 of the phantom power source 3, and the impedance converter 2 is connected in parallel to the diode D1. Thereby, a voltage generated from a small voltage drop at the diode D1 can be used to operate the impedance converter 2.

Furthermore, the voltage drop at the diode D1 remains at approximately 0.7 V even if the supply voltage of the phantom power source 2 is 48 V. Thus, the maximum amplitude at the output terminal A can be approximately 24 V.

In addition, the condenser microphone shown in FIG. 1 has a balanced output. Thus, a counterpart emitter-follower circuit of the transistor Q1 is composed of the transistor Q2, and the other output terminal B is provided between the supply resistor R2 and the emitter terminal of the transistor Q2.

As described above, the condenser microphone of the present invention can have an output circuit substantially identical to the output circuit shown in FIG. 6. The maximum output amplitude can thus be increased compared to a conventional condenser microphone.

According to the embodiment shown in FIG. 1, regardless of use of the transformer-free output circuit, the maximum output level can be increased compared to a conventional microphone and the maximum input sound pressure level can also be increased.

Figure 2:
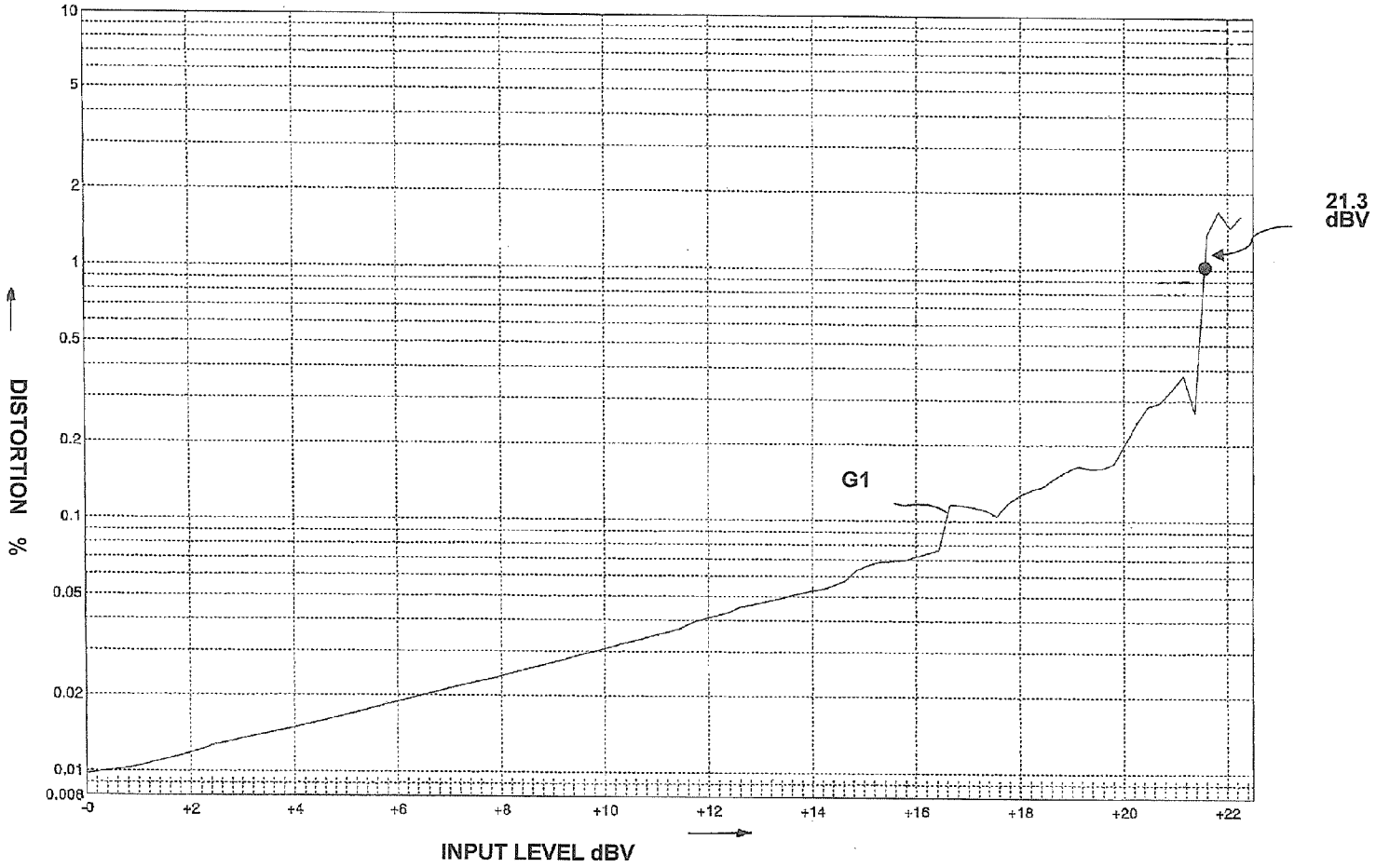
FIG. 2 is a graph illustrating observed results of the relationship between input level (dBV) and distortion of an output signal (%) of the embodiment.
Figure 5:
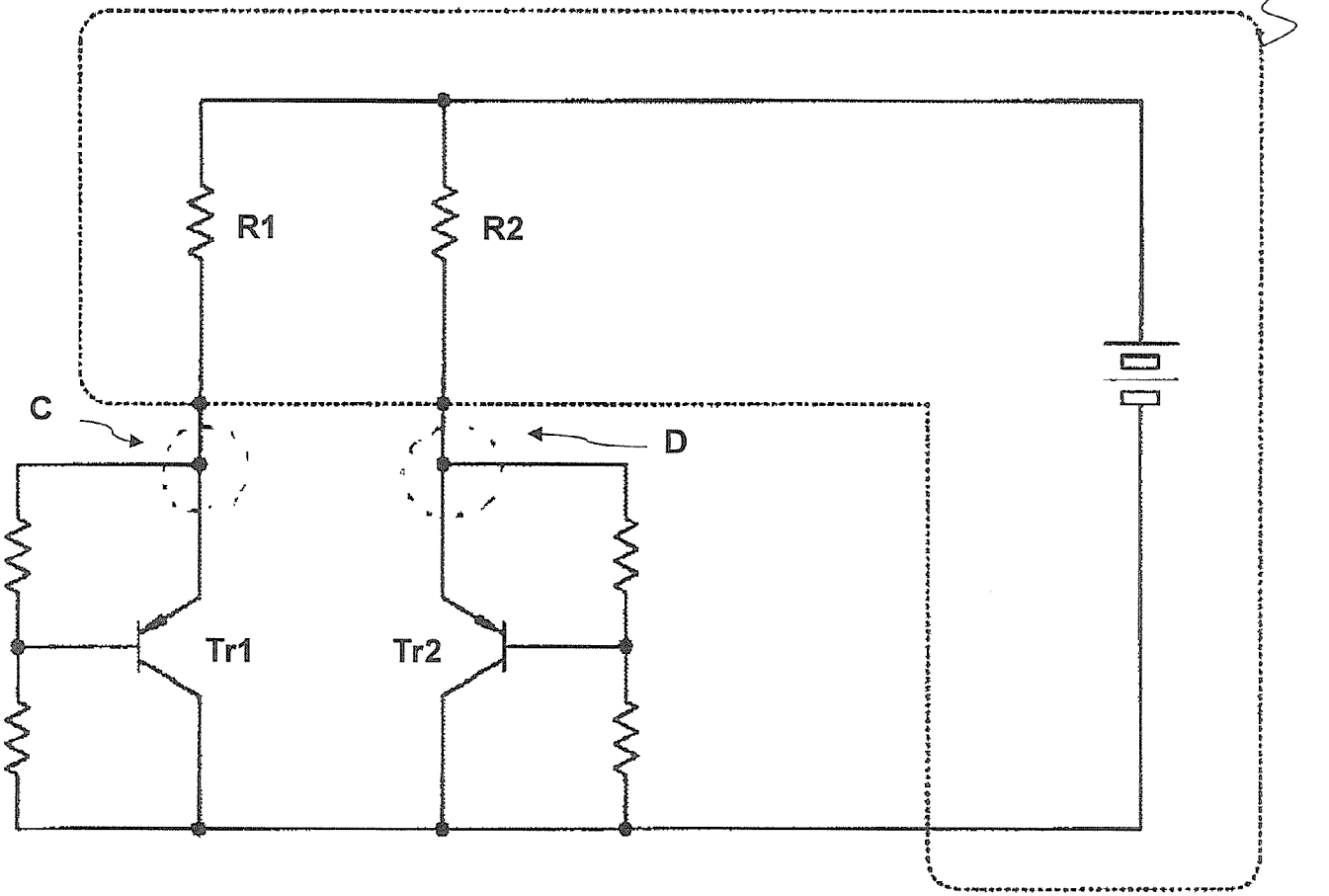
FIG. 5 (RELATED ART)
FIG. 5 is a circuit diagram illustrating an example of an output circuit of a condenser microphone.

FIG. 2 shows the results of the relationship between input level (dBV) and distortion of an output signal (%) observed with the condenser microphone of the embodiment shown in FIG. 1. A line G1 indicates a case of the condenser microphone 10 according to the embodiment operated at a power voltage of 48 V. As shown in FIG. 2, in the case where the acceptable upper limit of sound quality is defined as "a distortion of 1%," the maximum output level is approximately 21.3 dBV. The maximum output level of the condenser microphone of the embodiment can thus be higher than the maximum output level (approximately 18.7 dBV) of a condenser microphone having a conventional output circuit (refer to FIG. 5).

Figure 3:
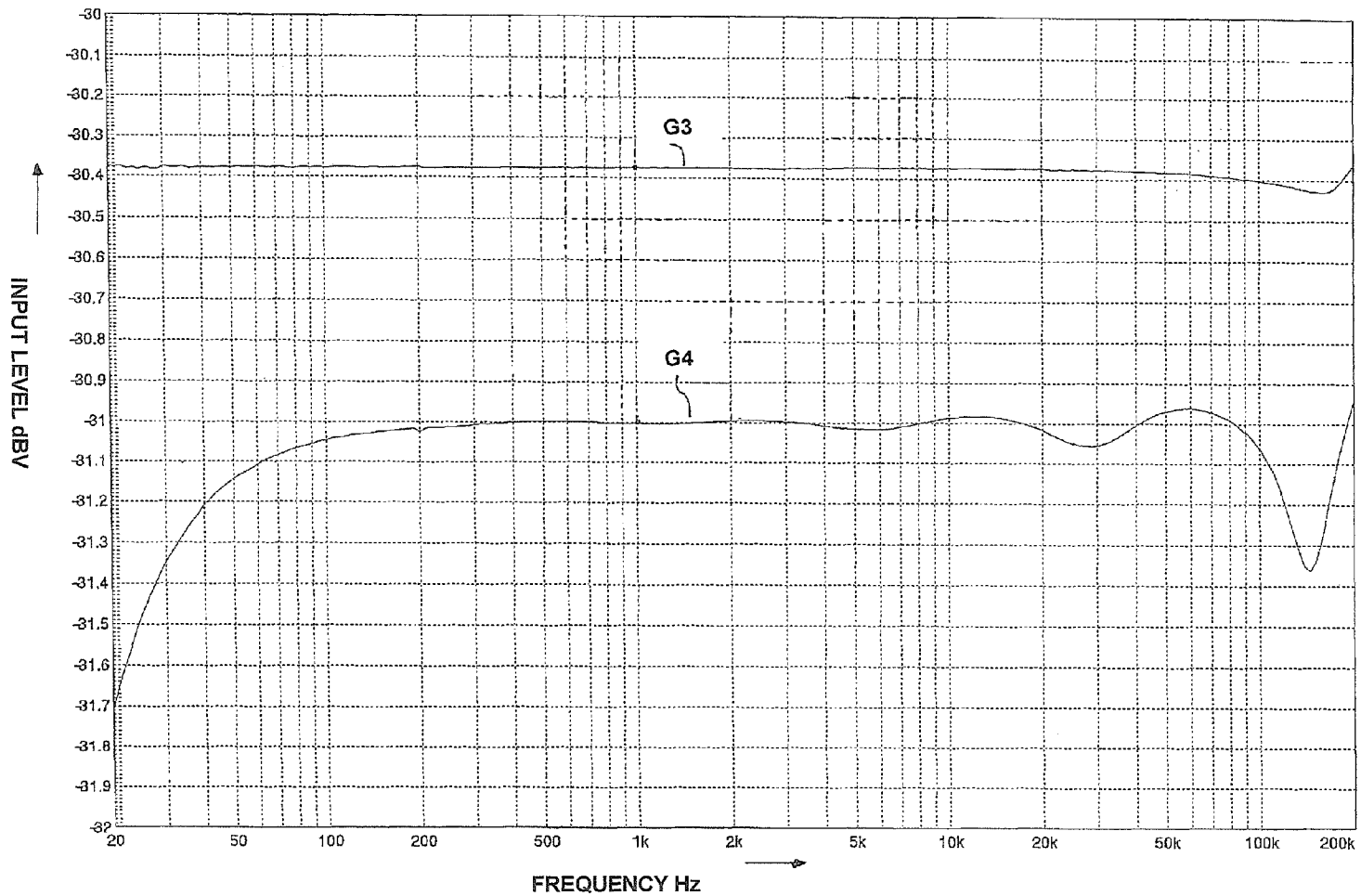
FIG. 3 is a graph illustrating the observed results of the relationship between frequency (Hz) and input level (dBV) of the embodiment.
Figure 4:
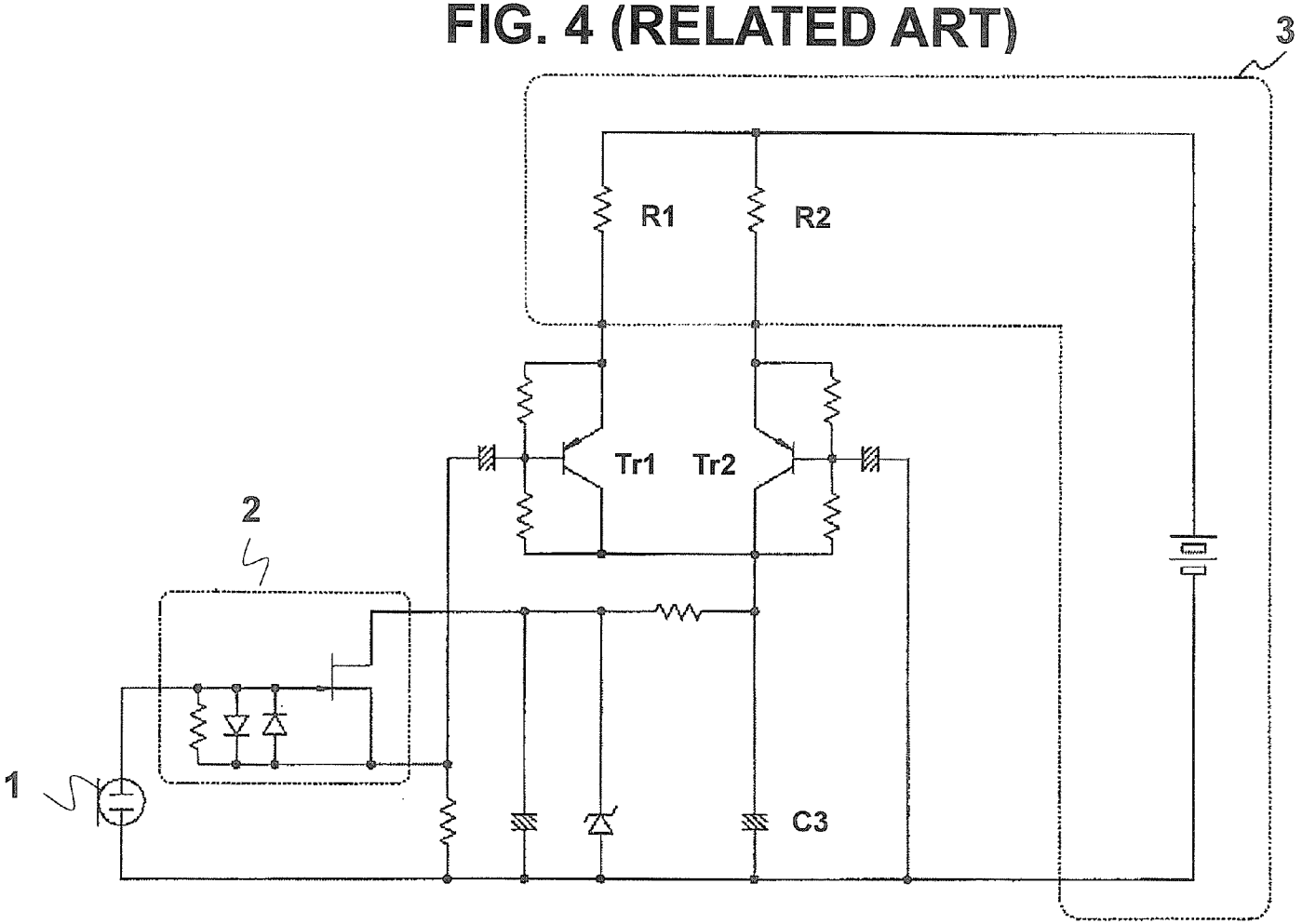
FIG. 4 (RELATED ART)
FIG. 4 is a circuit diagram illustrating an example of a conventional condenser microphone.

FIG. 3 shows the results of the relationship between frequency (Hz) and input level (dBV) observed with the condenser microphone of the embodiment shown in FIG. 1. A line G3 in FIG. 3 indicates the results of observed open voltage sensitivity using a measurement device having an input impedance of 100 kΩ. In the case of a variable frequency ranging from 20 Hz to 200 kHz at an input level of 30 dBV and an electrostatic capacitance of a condenser microphone unit of 18 pF, the fluctuation of the electrostatic capacitance is approximately 0.4 pF. A line G4 indicates the results observed at a load of 600Ω. The line G4 indicates that the output impedance of the condenser microphone of the embodiment is sufficiently small at 44Ω. Thus, the condenser microphone of the embodiment is of a practical level.

What is claimed is:

1. A condenser microphone comprising:

a microphone unit;

an impedance converter connected to the microphone unit comprising a FET;

a constant-voltage circuit; and an output circuit comprising an emitter-follower circuit having at least one transistor, the at least one transistor having an emitter terminal provided with the constant-voltage circuit;

wherein the FET of the impedance converter is operated by a voltage supplied from the constant-voltage circuit.

2. The condenser microphone according to claim 1, wherein the emitter-follower circuit of the output circuit is connected to a first output terminal of the microphone unit;

the output circuit further comprises a second emitter-follower circuit having at least one transistor with an emitter terminal and which is connected to a second output terminal of the microphone unit; and an output signal from the output circuit is balance-output from the emitter terminals of the at least one transistors of the first and second emitter-follower circuits.

3. The condenser microphone according to claim 1, wherein the constant-voltage circuit comprises a diode;

the diode has a cathode connected to the emitter terminal of the at least one transistor; and the diode has an anode connected to a supply resistor of a phantom power source.

4. The condenser microphone according to claim 1, wherein the at least one transistor has the emitter terminal connected in series with the constant-voltage circuit.

* * * * *